US006425505B1

(12) United States Patent
Heaslip et al.

(10) Patent No.: US 6,425,505 B1
(45) Date of Patent: Jul. 30, 2002

(54) POUR TUBE WITH IMPROVED FLOW CHARACTERISTICS

(75) Inventors: Lawrence John Heaslip; James Derek Dorricott, both of Burlington (CA); Quentin Robinson, Allegheny County, PA (US)

(73) Assignee: Vesuvius Crucible Company, Wilmington, DE (US)

( * ) Notice: Subject to any disclaimer, the term of this patent is extended or adjusted under 35 U.S.C. 154(b) by 0 days.

(21) Appl. No.: 09/632,136

(22) Filed: Aug. 3, 2000

Related U.S. Application Data

(60) Provisional application No. 60/152,440, filed on Sep. 3, 1999.

(51) Int. Cl.[7] ..... B22D 41/08

(52) U.S. Cl. ..... 222/594; 222/590; 222/606; 164/437

(58) Field of Search ..... 222/591, 594, 222/606, 607, 590; 164/437

(56) References Cited

U.S. PATENT DOCUMENTS

| | | | | |
|---|---|---|---|---|
| 3,991,815 A | * | 11/1976 | Fastner et al. | 222/606 |
| 4,566,614 A | | 1/1986 | Frykendahl | |
| 5,083,687 A | | 1/1992 | Saito et al. | |
| 5,328,064 A | | 7/1994 | Nanba et al. | |
| 5,785,880 A | | 7/1998 | Heaslip et al. | |
| 5,885,520 A | | 3/1999 | Hoover | |
| 5,902,511 A | | 5/1999 | Perich et al. | |

FOREIGN PATENT DOCUMENTS

| | | | | |
|---|---|---|---|---|
| EP | 0765702 B1 | | 5/1999 | |
| JP | 57-146942 A | | 9/1982 | |
| JP | 57-189655 A | | 12/1982 | |
| JP | 58-107252 A | | 7/1983 | |
| JP | 59-22913 A | | 7/1984 | |
| JP | 60-108455 A | | 7/1985 | |
| JP | 61-72361 A | | 5/1986 | |
| JP | 61-180668 A | | 8/1986 | |
| JP | 63-2545 A | | 1/1988 | |
| JP | 64-5761 A | | 1/1989 | |
| JP | 2-41747 A | | 2/1990 | |
| JP | 02041747 | * | 2/1990 | 222/606 |
| JP | 03207556 | * | 9/1991 | 222/606 |
| JP | 4-455 A | | 1/1992 | |

OTHER PUBLICATIONS

Shinagawa Refractories Co. Technical Report vol. No. 36, Dec. 1993; Special Issue on Continuous Casting Refractories, Development and Application of Step Submerged Entry Nozzle: pp. 75–88.

The Technical Association of Refractories, Japan vol. 45, No. 10, Dec. 1993; Development and Appliacation of Annular Step–Submerged Entry Nozzle, Namba et al., pp. 587–588.

Shinagawa Refractories Co. Technical Report vol. No. 41, Dec. 1998; Prevention of Alumina Clogging in Submerged Entry Nozzles for Continuous Casting; pp. 37–46.

* cited by examiner

*Primary Examiner*—Scott Kastler
(74) *Attorney, Agent, or Firm*—James R. Williams

(57) ABSTRACT

A pour tube for use in the continuous casting of a stream of molten metal has a bore comprising a plurality of fluidly connected sections that improve the flow of molten metal through the bore. The sections reduce asymmetric flow of the molten metal stream and the likelihood of precipitates clogging the bore. Each section comprises a converging portion and a diverging portion. The converging portion deflects the stream toward the center of the bore, while the diverging portion diffuses the stream. The sections may comprise a plurality of frusto-conical sections. The cross-sectional areas of the sections may increase, decrease, or remain the same size from an upstream to a downstream position.

27 Claims, 3 Drawing Sheets

POUR TUBE WITH IMPROVED FLOW CHARACTERISTICS

CROSS-REFERENCE TO RELATED APPLICATIONS

This application is based upon and claims priority of U.S. Provisional Application No. 60/152,440 filed Sep. 3, 1999 which is hereby incorporated by reference.

BACKGROUND OF THE INVENTION

1. Field of the Invention

The invention relates to a pour tube for use in the continuous casting of molten metal. More particularly, the invention describes an article and method for improving flow characteristics of the molten metal.

2. Description of the Prior Art

In the continuous casting of metal, particularly steel, a stream of molten metal is typically transferred via a refractory pour tube from a first metallurgical vessel into a second metallurgical vessel or mold. Such tubes are commonly referred to as shrouds or nozzles, and possess a bore through which the metal passes. One important function of a pour tube is to discharge the molten metal in a smooth and steady manner without interruption or disruption. A smooth, steady discharge facilitates processing and can improve the finished product.

Factors, which can disrupt the steady discharge, include asymmetric flow of molten metal and clogging of the bore. Asymmetric flow may develop before or after the stream is in the bore. For example, while flowing through a bore, a stream may develop higher fluid velocity near the centerline of the bore than along the sides of the bore, or lower velocity on one side of the centerline as compared to the opposite side, or higher fluid velocity off the centerline. The disparate velocities can cause pulsing and excessive turbulence upon exiting the bore, thereby complicating processing and decreasing the quality of the finished product. Throttling devices, such as stopper rods or slide gate valves, can partially obstruct the entrance to the bore, and cause the steam of molten metal to enter the bore off the centerline. The stream can flow preferentially down one side of the bore, and exit asymmetrically from the pour tube causing surging and turbulence in a mold.

Precipitates may also clog or restrict the bore so as to disrupt steady discharge of the molten metal. In molten steel, precipitates are primarily alumina and other high melting point impurities. Alumina deposits can lead to restrictions and clogging that can stop or substantially impede the smooth and steady flow of molten steel. Tubes may be unclogged using an oxygen lance; however, lancing disrupts the casting process, reduces refractory life, and decreases casting efficiency and the quality of the steel produced. A total blockage of the bore by precipitates decreases the expected life of the pour tube and is very costly and time-consuming to steel producers.

Prior art attempts to improve flow include both chemical and mechanical means. For example, flow may be improved by reducing alumina precipitation and subsequent clogging. Prior art has injected inert gas into the pour tube to shield the flow from the pour tube, thereby reducing precipitation and clogging. Unfortunately, gas injection requires large volumes of gas, complicated refractory designs, and is not always an effective solution. Gas may also dissolve or become entrapped within the metal causing problems in metal quality including pinhole defects in the steel. Alternatively or in combination with gas injection, prior art has lined the bore with refractory compositions that are claimed to resist alumina buildup. Compositions include lower melting point refractories, such as $CaO—MgO—Al_2O_3$ eutectics, MgO, calcium zirconate and calcium silicide, that slough off as alumina deposits on the surface. These compositions tend to crack at high temperature, and, during casting, they may hydrate and dissipate. For these reasons, their useful life is limited. Other surface compositions that claim to inhibit alumina deposition, include refractories containing SiAlON-graphite, metal diborides, boron nitrides, aluminum nitride, and carbon-free compositions. Such refractories can be expensive, impractical, and manufacturing can be both hazardous and time consuming.

Mechanical designs for improving flow include U.S. Pat. No. 5,785,880 to Heaslip et al., which teaches a pour tube having a diffusing geometry that smoothly delivers a stream of molten metal to a mold. Alternative designs include EP 0 765 702 B1, which describes a perforated obstacle inside the bore that deflects the stream from a preferred trajectory. Both references attempt to control the introduction of molten metal into a mold by mechanically manipulating the stream of molten metal. Neither describes alumina clogging or the reduction of alumina clogging.

Prior art also includes designs that claim to improve flow by reducing alumina deposition in the bore. These designs include pour tubes with both conical and "stepped" bores. U.S. Pat. No. 4,566,614 to Frykendahl teaches an inert gas-injection nozzle having a conical bore intended to reduce "pulsations" in the gas flow. Smoother gas flow into the bore is said to reduce clogging. "Stepped" designs include pour tubes that have discontinuous changes in bore diameter. Stepped designs also include pour tubes having a spiral bore. JP Kokai 61-72361 is illustrative of stepped pour tubes, and describes a pour tube having a bore with at least one convex or concave section that generates turbulent flow in the molten metal. Turbulent flow, as contrasted with lamina flow, is described as reducing alumina clogging. U.S. Pat. No. 5,328,064 to Nanbo et al. teaches a bore having a plurality of concave sections separated by steps having a constant diameter, d. Each section has a diameter greater than d, and preferably the diameters of the sections decrease along the direction of flow. The steps are described as generating turbulence that reduces alumina clogging.

Prior art stepped designs show turbulent flow only at a step or the beginning or end of a section. None describe turbulent flow away from these features, including at the middle of the section. Non-turbulent flow permits alumina to buildup on the surface of the bore, and can lead to clogging of the bore away from the step. Further, no prior art design simultaneously describes a pour tube that reduces asymmetric flow of molten metal passing through the pour tube's bore and the relationship between reduced asymmetric flow and alumina clogging.

A need persists for a refractory pour tube that inhibits alumina deposition along the entire length of the bore. Ideally, such a tube would also improve the flow of molten metal into a casting mold.

SUMMARY OF THE INVENTION

The present invention relates to an article and method for improving flow of a stream of molten metal and reducing alumina precipitation in a bore of the article. In a broad aspect, the article comprises a pour tube having a bore comprised of a series of fluidly connected sections each of which converges and diverges to continuously alter and diffuse the contained stream.

In one aspect, the pour tube has a bore comprised of a series of fluidly connected sections where each section has a sharply converging portion and a slowly diverging portion. The combination of the converging and diverging elements can reduce flow asymmetry, reduce alumina deposition in the bore, and inhibit surging and asymmetry in the flow exiting the bore. In one embodiment, the converging portion is upstream of the diverging portion.

The converging portion comprises a step inclined at a sharp angle from the center axis. The diverging portion comprises a length and an inside surface that, in the direction of flow, diverges from the center axis at a diverging angle which is significantly smaller than the sharp angle of the inclined step. The diverging angle is large enough to diffuse the stream of metal, but small enough to prevent pressure drops or separation of the stream. Each section has inlet and outlet cross-sectional areas. From section to section, the inlet and outlet areas may increase, decrease, or remain relatively constant in the direction of flow, thereby reducing, increasing, or maintaining the mean velocity of the contained stream as desired for the flow exiting the bore.

In another aspect of the invention, the pour tube has a bore comprised of a series of fluidly connected sections, where each section has a sharply converging means and a slowly diverging means. The converging means deflects the stream toward the center axis of the bore, and the diverging means directs the stream away from the center axis without separation of the stream. In a further embodiment of the invention, he pour tube has a bore comprising a series of fluidly connected, frusto-conical sections with a converging means between each section.

The method of the invention has a pour tube with a bore comprised of a series of fluidly connected sections, and includes converging the stream of molten metal at the inlet of each section and diverging the stream without separation along the length of the section.

Other details, objects and advantages of the invention will become apparent as the following description of a present preferred method of practicing the invention proceeds.

DETAILED DESCRIPTION OF INVENTION

The invention comprises a pour tube having a throughflow bore for use in the continuous casting of molten metal. A pour tube includes shrouds, nozzles, and other refractory pieces for containing a stream of molten metal, including, for example, submerged entry shrouds and nozzles, inner nozzles, and well-block nozzles. The stream passes from an upstream position, through the bore, to a downstream position. The bore comprises a plurality of fluidly connected sections. The sections are most frequently linked in series so that the stream passes from an upstream section to a first downstream section, and optionally to a second and subsequent downstream section(s).

Figure 1:
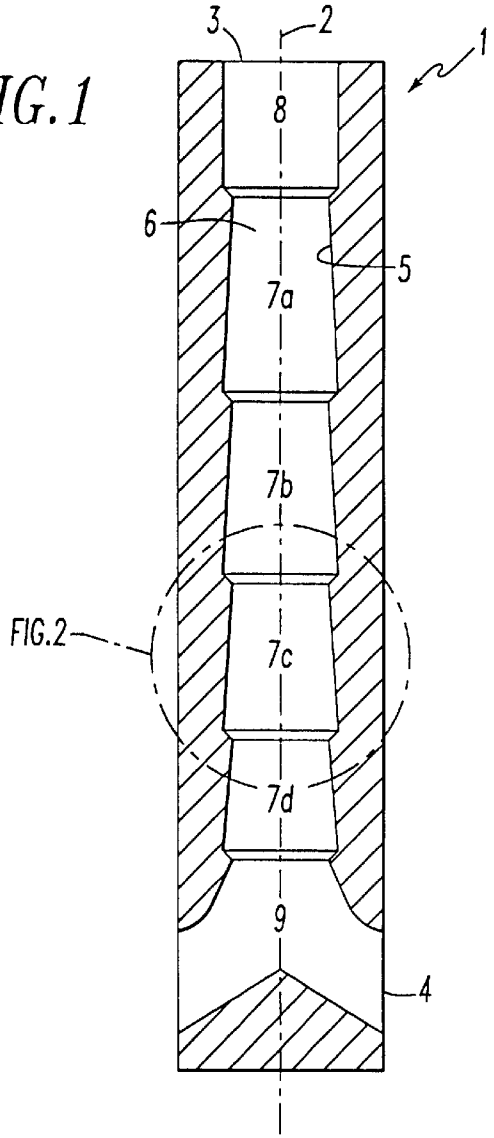
FIG. 1 shows a pour tube of the current invention.

As shown in FIG. 1, the pour tube (1) has a longitudinal axis (2) extending from an upstream position (3) to a downstream position (4). The inside surface (5) of the pour tube (1) defines a throughflow bore (6) along the longitudinal center axis (2). The bore (6) is divided into a plurality of sections (7*a–d*) fluidly connected in series. The number of sections (7) may vary depending on the particular casting conditions. Commonly, the tube (1) will also have an entry segment (8) and an exit segment (9).

Figure 2:
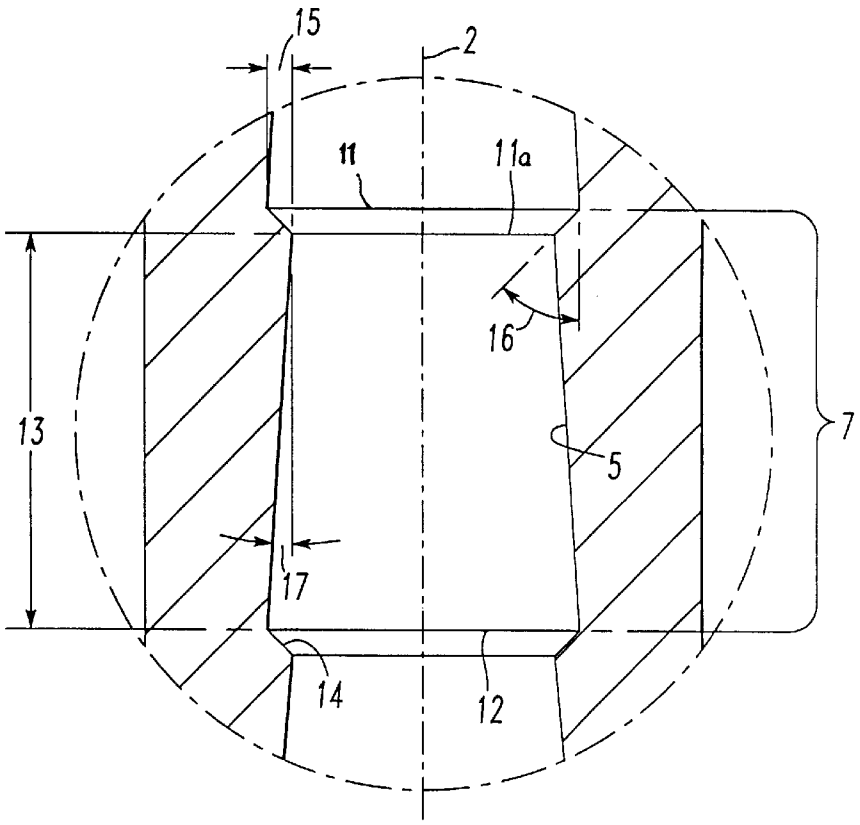
FIG. 2 shows a single section of the pour tube.

As shown in FIG. 2, each section (7) has an inlet (11) with a constriction (11*a*), an outlet (12), a diverging length (13) between the constriction (11*a*) and the outlet (12), and a sharply converging step (14) between the inlet (11) and the constriction (11*a*). The inlet has an inlet cross-sectional area, the constriction has a constriction cross-sectional area and the outlet has an outlet cross-sectional area. The sharply converging step (14) is defined by an angle of inclination (16) from the axis (2) and a width (15) perpendicular to the axis (2). Along the length (13) of the section, the inside surface (5) diverges from the axis (2) at a diverging angle (17).

The number of fluidly connected sections can vary depending on the size of the pour tube, and the sections may be of different geometries and dimensions. The sections need hot occupy the entire length of the bore, but preferably the sections will comprise a majority of the bore. For example, a pour tube comprising a submerged entry shroud typically has 2 to 6 sections plus an entry segment and an exit segment. Each section comprises a sharply converging portion and a slowly diverging portion and preferably the converging portion will be upstream of the diverging portion. A first section will have a converging portion upstream of the diverging portion in order to direct the stream towards the center axis of the bore. Typically, the first section will immediately follow an entry segment.

A sharply converging portion will direct the stream of molten metal towards the center axis of the bore, and comprises a step defined by an inclination angle and a width perpendicular to the longitudinal axis. Centering the stream aids in producing a more symmetrical stream of molten metal exiting the tube. The inclination angle is that angle between the longitudinal axis and the inclination of the step. The inclination angle may be in the range from 35 to 90 degrees, with typical values in the range from 60 to 90 degrees. The degree to which the stream is directed toward the center is related to a magnitude of convergence, which is the ratio of the cross-sectional area of the width to the inlet cross-sectional area. The cross-sectional area of the width is equal to the difference between the inlet cross-sectional area of a section and its constriction cross-sectional area. Useful values for the magnitude of convergence ratio range from 15% to 60%, with typical values from 20% to 40%.

A slowly diverging portion diffuses the stream of molten metal, and introduces a spreading component to the stream. Preferably, diffusion should take place without separation or cavitation of the stream. Both can lead to a drop in pressure that facilitates alumina deposition or plugging. Typically, diffusion causes the mean velocity of the stream to decrease between the inlet and the outlet of a section. A decrease in mean velocity corresponds to an increase in mean pressure and a likely reduction in alumina deposition. Diffusion can be accomplished, for example, by setting the outlet cross-sectional area greater than the inlet cross-sectional area; although, this relationship between the outlet and inlet cross-sectional areas is not a strict requirement as diffusion is accomplished by providing an outlet cross-sectional area greater than the constriction cross-sectional area. Highly asymmetric incoming streams, for example, are likely to diffuse regardless of the cross-sectional areas of the inlet and outlet. The combination of the constricting and diverging elements of a section enhances the diffusion rate, which improves flow symmetry while simultaneously reducing the clogging tendency.

The diverging portion is commonly symmetrical about the longitudinal center axis, resulting in a circular cross-sectional area and a frusto-conical bore geometry. As required, the diverging portion may also have an elliptical cross-sectional area. Alternatively, the diverging portion may be otherwise symmetric, including, for example, planarly symmetric, or even asymmetric. Planar symmetry, that is, a substantially rectangular cross-section, is particularly effective in thin slab or thin strip casting operations.

Figure 3A:
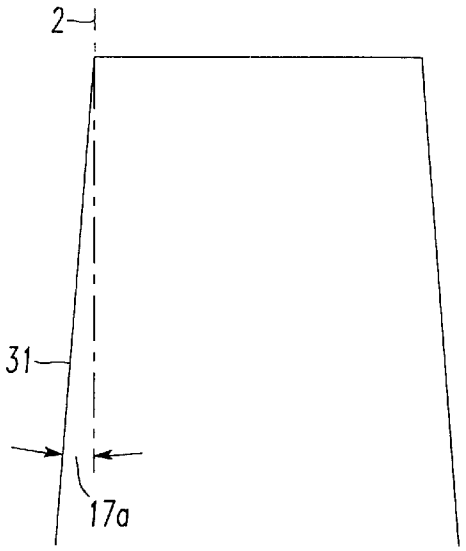
FIGS. 3*a* and 3*b* show a first and second diverging angle in a pour tube with planar symmetry.
Figure 3B:
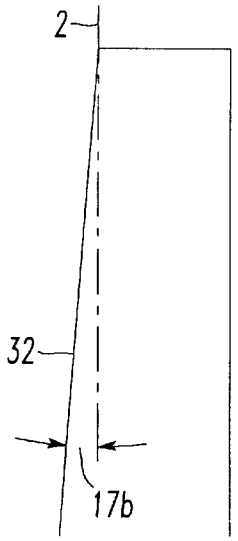

The diverging portion comprises a length and a diverging angle. The length of the diverging portion is generally related to the diverging angle and the width of the converging portion. Typically, the length is approximately equal to the width divided by the tangent of the mean diverging angle. The diverging angle is the angle formed between the longitudinal axis and the tangent to the inside surface of the bore. The diverging angle should be small enough to prevent separation, but large enough to permit diffusion. The angle will depend on the geometry of the bore. For example, with a frusto-conical diverging portion, the diverging angle should be significantly less than the inclination angle of the converging step and typically less than 4 degrees. Other geometries may have a plurality of diverging angles. For example, as shown in FIGS. 3*a* and 3*b*, a rectangular diverging portion may have a first diverging angle (17*a*) along a first face (31) and a second diverging angle (17*b*) along a second face (32). The first and second diverging angles may or may not be equal. In another embodiment, the diverging portion may have a continuously variable diverging angle, such as when the diverging portion is flared.

Figure 4:
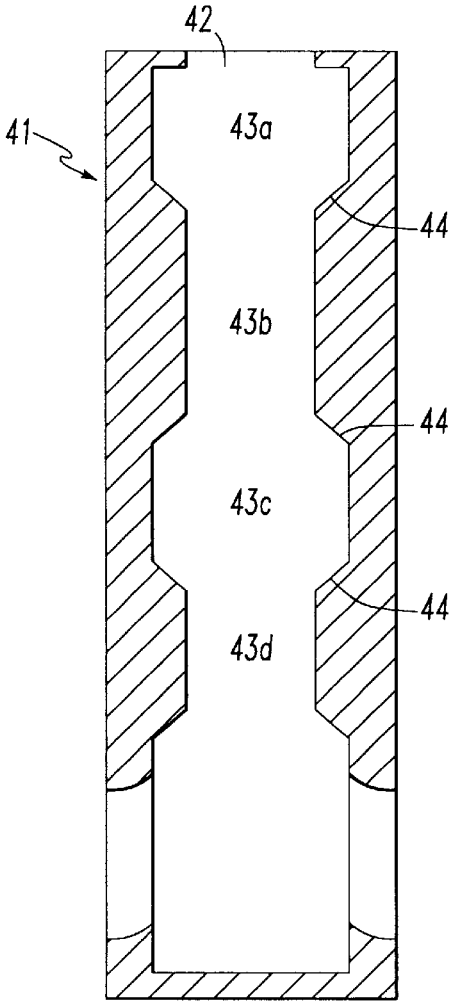
FIG.4 PRIOR ART
FIG. 4 shows a prior art, stepped pour tube.
Figure 5A:
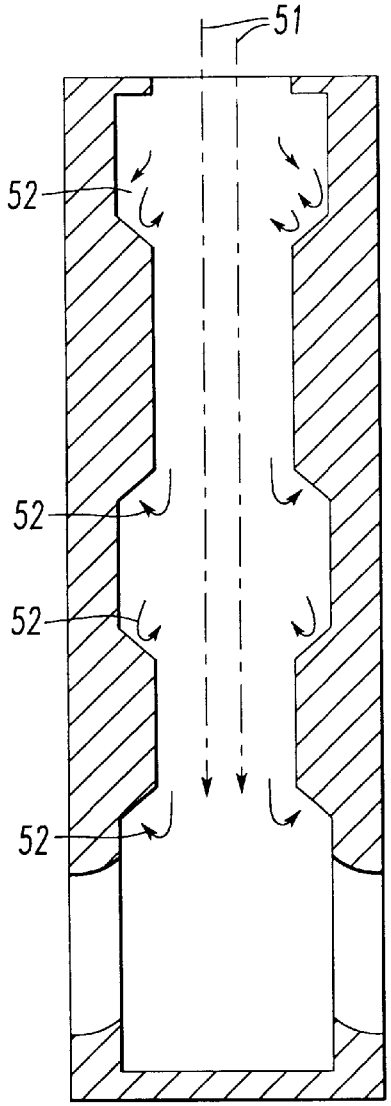
FIG.5a PRIOR ART
FIGS. 5*a* and 5*b* show turbulent flow patterns in a prior art, stepped pour tube and the pour tube of the present invention, respectively.
Figure 5B:
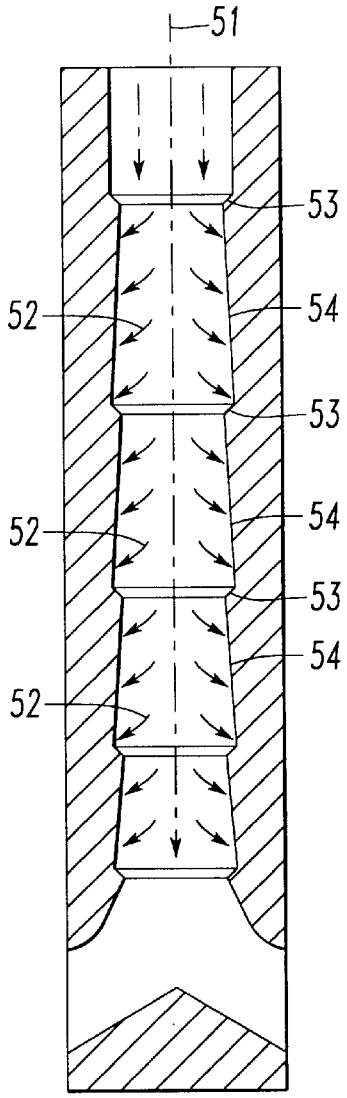

A prior art pour tube is shown in FIG. 4. The tube (41) comprises a bore (42) having a series of fluidly connected sections (43*a–d*) separated by steps (44). FIG. 5*a* shows the flow contours (51) and turbulence (52) of the prior art tube. Turbulence adjacent to the sides of the bore is limited to the region immediately before and after the steps. In contrast, FIG. 5*b* shows flow contours (51) in a pour tube having frusto-conical sections. In each section, the flow is continuously altered improving the overall flow symmetry and steadiness while creating turbulence (52) adjacent to the walls of the bore before and after the converging portions (53), and throughout the diverging portions (54).

Obviously, numerous modifications and variations of the present invention are possible. It is, therefore, to be understood that within the scope of the following claims, the invention may be practiced otherwise than as specifically described.

We claim:

1. A pour tube for reducing alumina clogging in continuous casting of a stream of molten metal from an upstream position to a downstream position along a longitudinal center axis, the pour tube comprising an inner surface defining a throughflow bore between the upstream and downstream positions, the bore comprising a plurality of fluidly connected sections, where each section comprises:

an inlet having an inlet cross-sectional area perpendicular to the center axis;

a sharply converging step downstream of the inlet for directing the stream towards the center axis;

a constriction downstream of the converging step having a constriction cross-sectional area perpendicular to the center axis;

a slowly diverging portion downstream of the constriction for diffusing the stream, whereby turbulence is generated along the inner surface and alumina clogging is reduced; and an outlet downstream of the diverging portion having an outlet width and an outlet cross-sectional area perpendicular to the center axis.

2. The pour tube of claim 1, wherein the converging step comprises an inclined surface having an inclination angle between the inclined surface and the center axis.

3. The pour tube of claim 2, wherein the inclination angle is in the range from 35 to 90 degrees.

4. The pour tube of claim 3, wherein the inclination angle is in the range from 60 to 90 degrees.

5. The pour tube of claim 1, wherein each section has a width cross-sectional area defined as the difference between the inlet cross-sectional area and the constriction cross-sectional area, and a magnitude of convergence defined as a ratio of the width cross-sectional area to the inlet cross-sectional area.

6. The pour tube of claim 5, wherein the magnitude of convergence is in the range from 15 to 60 percent.

7. The pour tube of claim 5, wherein the magnitude of convergence is in the range from 20 to 40 percent.

8. The pour tube of claim 1, wherein the diverging portion comprises:

a length along the center axis, and a diverging angle between the center axis and a tangent to the inner surface of the bore in the diverging portion, where the diverging angle is large enough to permit diffusion of the stream and small enough to prevent separation.

9. The pour tube of claim 8, wherein the diverging angle is constant.

10. The pour tube of claim 8, wherein the diverging angle is less than 4 degrees.

11. The pour tube of claim 8, wherein a trigonometric tangent of the diverging angle is essentially equal to the outlet width divided by the length.

12. The pour tube of claim 1, wherein the outlet cross-sectional area is greater than the inlet cross-sectional area.

13. The pour tube of claim 1, wherein the outlet cross-sectional areas increase from an upstream section to a downstream section.

14. A pour tube for reducing alumina clogging in continuous casting of a stream of molten metal from an upstream position to a downstream position along a longitudinal center axis, the pour tube comprising an inner surface defining a throughflow bore between the upstream and downstream positions, the bore comprising a plurality of fluidly connected sections, where each section comprises:

an inlet;

a converging means downstream of the inlet for sharply converging the stream towards the center axis;

a diverging means downstream of the converging means for slowly diverging the stream from the center axis without separation of the stream, whereby turbulence is generated along the inner surface and alumina clogging is reduced; and an outlet.

15. The pour tube of claim 14, wherein the converging means is upstream of the diverging means.

16. The pour tube of claim 14, wherein the stream has a mean velocity, and the diverging means reduces the mean velocity.

17. A method of moving a stream of molten metal from a first vessel to a second vessel through a pour tube while reducing alumina clogging, the pour tube having a longitudinal center axis between an upstream position and a downstream position and an interior surface defining a bore with a plurality of fluidly connected sections, where each section comprises an inlet upstream of an outlet, the inlet having an inlet cross-sectional area, and the outlet having an outlet cross-sectional area, the method comprising:

(a) converging the stream in each section toward the center axis; and (b) diverging the stream in each section while inhibiting separation of the stream, whereby turbulence is generated along the inner surface and alumina clogging is reduced.

18. The method of claim 17, further providing continuously diffusing the stream while diverging the stream.

19. The method of claim 17, further providing decreasing a mean velocity of the stream from the upstream position to the downstream position.

20. The method of claim 17, further providing increasing the inlet area from an upstream section to a downstream section.

21. The method of claim 17, further providing increasing the outlet area from an upstream section to a downstream section.

22. A pour tube for reducing alumina clogging in continuous casting of a stream of molten metal from an upstream position to a downstream position along a longitudinal center axis, the pour tube comprising an inner surface defining a throughflow bore between the upstream and downstream positions, the bore comprising a plurality of fluidly connected, frusto-conical sections, each section comprising:

an inlet having an inlet cross-sectional area perpendicular to the center axis;

a sharply converging step downstream of the inlet for directing the stream towards the center axis;

a constriction downstream of the converging step having a constriction cross-sectional area perpendicular to the center axis;

a slowly diverging portion downstream of the constriction for diffusing the stream, whereby turbulence is generated along the inner surface and alumina clogging is reduced; and an outlet downstream of the diverging portion having an outlet width and an outlet cross-sectional area perpendicular to the center axis.

23. The pour tube of claim 22, wherein the converging step comprises an inclined surface having an inclination angle between the inclined surface and the center axis.

24. The pour tube of claim 23, wherein the inclination angle is in the range from 35 to 90 degrees.

25. The pour tube of claim 22, wherein the frusto-conical section has a cone angle between the center axis and a tangent of the inner surface in the diverging portion, and the cone angle is less than 8 degrees.

26. The pour tube of claim 22, wherein the cross-sectional areas of the inlets increase from the upstream position to the downstream position.

27. The pour tube of claim 22, wherein the cross-sectional areas of the outlets increase from the upstream position to the downstream position.

* * * * *